United States Patent [19]

Ward

[11] 4,438,876

[45] Mar. 27, 1984

[54] COMBINATION BACK PACK AND TENT FRAME

[76] Inventor: Russell G. Ward, 2050 SW. 71st Ave., Portland, Oreg. 97225

[21] Appl. No.: 275,062

[22] Filed: Jun. 18, 1981

[51] Int. Cl.[3] ..... A45F 3/08

[52] U.S. Cl. ..... 224/154; 135/108; 135/95

[58] Field of Search ..... 224/154; 135/4 R, 108, 135/107, 106, 101, 95

[56] References Cited

U.S. PATENT DOCUMENTS

| | | | |
|---|---|---|---|
| 3,923,217 | 12/1975 | Dean II | 224/154 |
| 3,931,918 | 1/1976 | Smith | 224/154 |
| 4,251,015 | 2/1981 | Gale | 135/4 R |

*Primary Examiner*—Richard C. Pinkham
*Assistant Examiner*—T. Brown
*Attorney, Agent, or Firm*—James D. Givnan, Jr.

[57] ABSTRACT

A back pack frame is comprised of tubular frame members which upon separation permit extraction of pairs of tent frame components stowed therein. The frame members and tent frame components are thereafter rejoinable to provide a geodesic tent frame. The tent frame components, upon extraction from a stowed position within the back pack frame members, are positioned in a divergent manner as permitted by a wire hinge component interconnecting the paired tent frame components. The back pack frame members are slotted at their ends to permit such divergent positioning of the associated tent frame components and include limit stops to prevent complete separation of the tent frame components from their frame member. The back pack frame members themselves are coupled to one another by flexible wire inserts and, in a modified form, by molded socket members. A back pack bag may be supported either externally on the back pack frame or, alternatively, over frame members.

13 Claims, 8 Drawing Figures

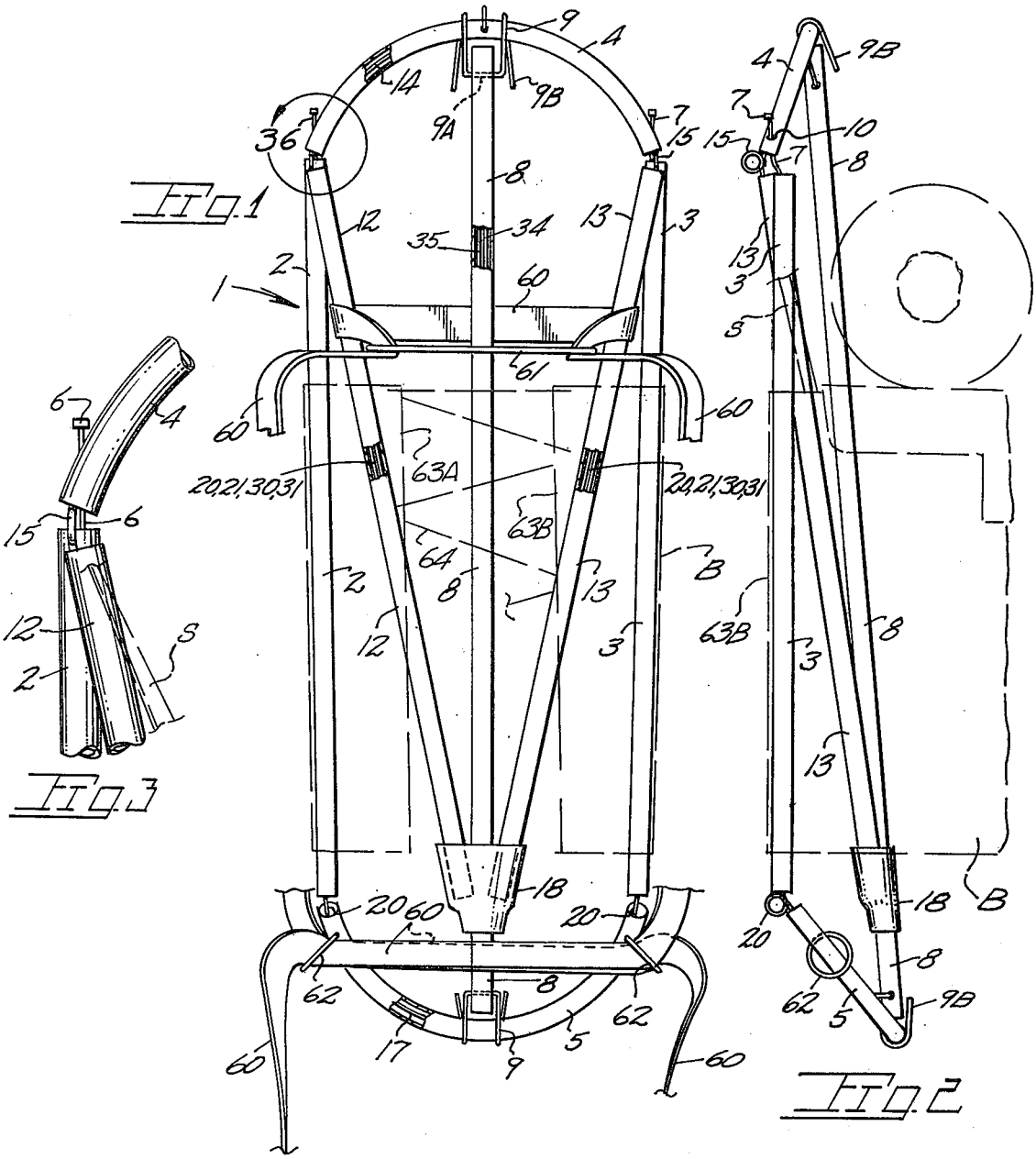
FIG. 1
FIG. 2
FIG. 3
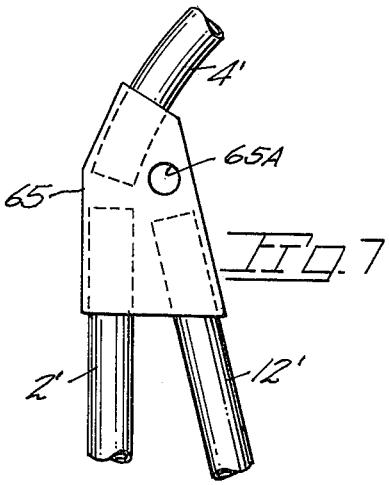
FIG. 7
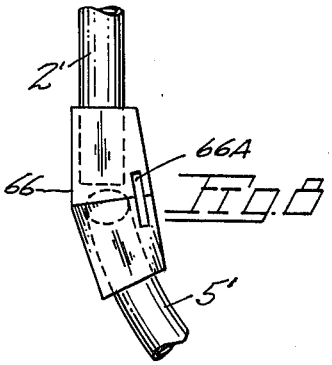
FIG. 8

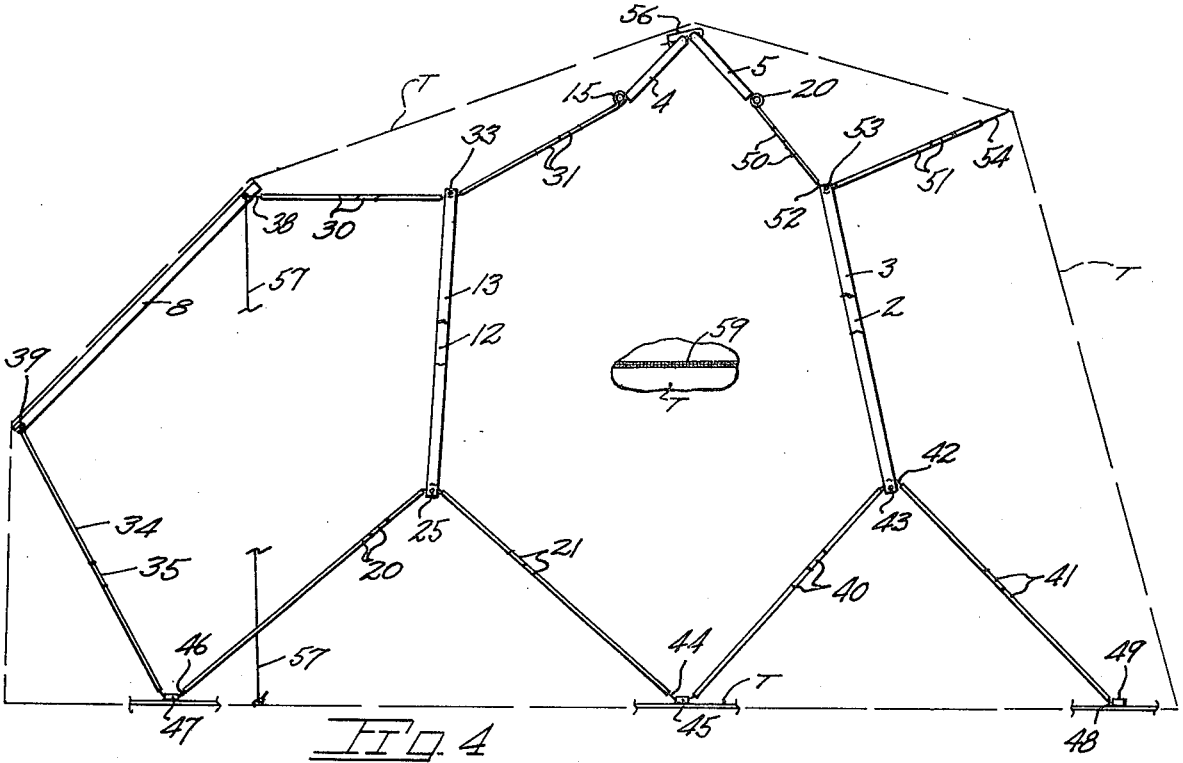
FIG. 4
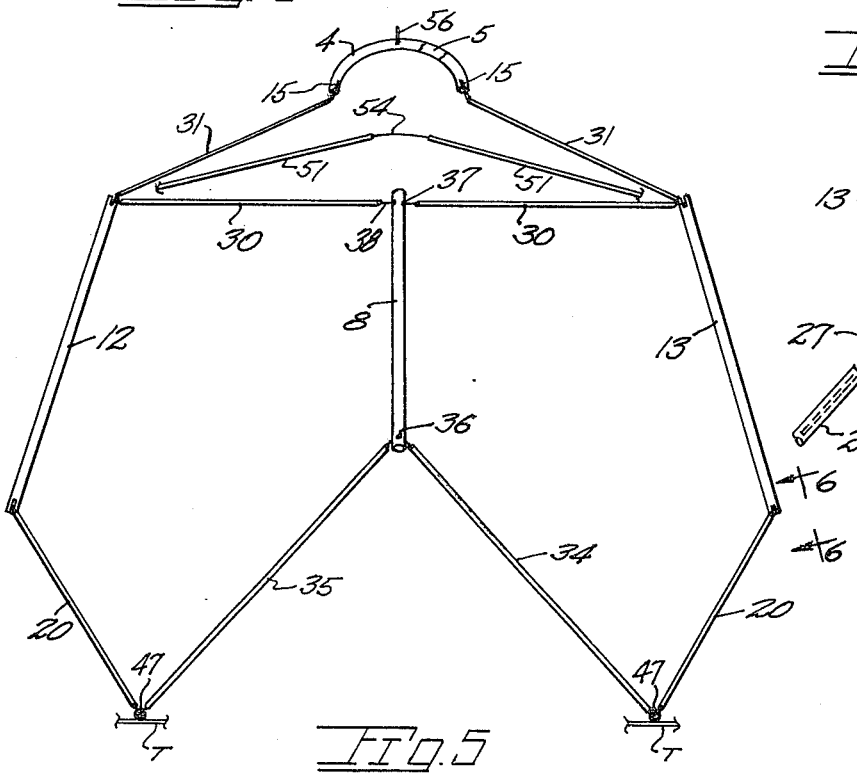
FIG. 5
FIG. 6
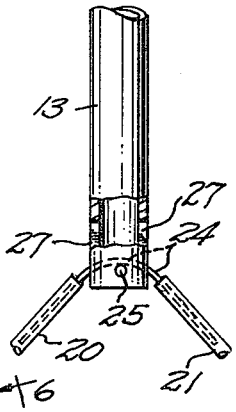

COMBINATION BACK PACK AND TENT FRAME

BACKGROUND OF THE INVENTION

The present invention concerns back pack frames of the type used to transport equipment carried by outdoorsmen.

Back pack frames typically provide means for supporting a large fabric bag on the outdoorsman's back. For purposes of weight economy, back pack frames are commonly of lightweight metal tubing and serve but a single function, i.e., the support of the equipment filled frame attached bag. In conventional back pack frames, the frame members are more or less permanently joined to one another and serve no secondary purpose.

The prior art discloses collapsible tent frames which may be folded in a compact manner for transport on the user's back. An example of the known prior art is found in U.S. Pat. No. 3,931,918. Disclosed in this patent is a pack frame having a pair of main upright tubular members within which are stowed, one each, adjustable tent frame members which are detached from the back pack frame prior to use as tent frame members. The back pack frame serves but a minor tent frame function, i.e., the support of one end of a tent ridge pole.

U.S. Pat. No 4,077,418 discloses a tent frame having both hingedly and telescopically connected members all of which may be collasped into a U-shape configuration to permit carrying on the user's back but which do not provide any type of back pack.

U.S. Pat. No. 3,055,380 discloses still another tent frame having telescopic members which also collapse into a U-shape to facilitate transport.

U.S. Pat. No. 3,467,114 discloses the concept of forming three dimensional frames by applying axially directed forces to one end of a flexible metal member while restricting travel of the remaining end of same. This last mentioned patent discloses a tent frame in no way associated with any type of back pack, nor is the present concept utilized of a tent frame having hingedly interconnected extensible members capable of being interconnected with other extensible members at their distal ends.

With attention again to U.S. Pat. No. 3,931,918 no provision is made for utilizing all of the back pack frame members for telescopic storage of tent frame members nor does the frame disclosed provide for complete disassembly of the back pack frame and complete reorientation of same as a tent frame.

SUMMARY OF THE PRESENT INVENTION

The present invention is embodied within a back pack frame of tubular construction with separable frame members rejoinable as tent frame members.

The tent frame constructed from the present back pack frame provides a geodesic structure particularly suited to supporting tent in both moderate as well as adverse weather conditions rendering the same usable to those erecting tents in unprotected, windy areas such as exposed mountain or glacial areas. Rigid, tubular members of the back pack frame house two or more hingedly joined extensible components which upon frame disassembly may be extended and positioned to function as tent frame members.

The extensible components are interconnected by a hinge which permits divergent positioning of the paired components upon their extraction from their tubular member. A limit stop adjacent each end of the tubular member prevents full separation of the tubular member and the hingedly joined, extensible components. Upon divergent positioning of the paired extensible components members, each of same may be joined at ground level with an adjacent extensible member in a semi-permanent manner as by an inserted wire segment. Upper and lower members of the back pack frame are of semicircular configuration and may be joined to constitute part of the tent frame. A fabric bag, generally similar to existing back pack bags, is attachable to the back pack frame and serves to receive various items of camping gear as well as the tent cover which is desirably of a sturdy lightweight synthetic material for compact stowage. Additionally provided is tensioning member by which a downward force may be exerted on a tent frame component to in turn impart forces to various tent frame components to enhance frame rigidity.

The back pack frame members are joined in separable manner by coupling means which includes inserted flexible wire segments or, in a modified form, molded sockets.

Important objectives of the present invention include the provision of a back pack frame of tubular construction wherein the frame members also serve as structural tent frame members; the provision of a back pack frame having separable rigid tubular members each of which is also utilized in a tent frame which additionally includes hingedly joined components extracted from the tubular back pack members; the provision of a back pack frame which conveniently houses tent frame members to permit the back pack bag area to be used entirely for personal camping gear heretofore hindered by the stowage therein of tent frame components; the provision of a portable structure having tubular members within which are removably stowed elongate components, the latter serving to interconnect the tublar members to form the framework of a shelter; the provision of a structure having interconnected rigid members which are separable to form the framework of a shelter which framework additionally includes components normally housed within said rigid members; the provision of a back pack frame wherein frame members are detachably joined by coupling means including flexible inserted wire segments or alternatively molded sockets. Other objectives will become apparent upon a reading of the following description of the invention.

BRIEF DESCRIPTION OF THE DRAWINGS

In the accompanying drawings:

FIG. 1 is a front elevational view of a back pack frame of the present invention;

FIG. 2 is a right side elevational view thereof;

FIG. 3 is an enlarged view of that structure encircled at 3 in FIG. 1;

FIG. 4 is a side elevational view of a tent frame of the present invention;

FIG. 5 is a left side elevational view of FIG. 3;

FIG. 6 is an elevational fragmentary view of hinge and limig stop means of the present invention taken along line 6—6 of FIG. 5; and FIGS. 7 and 8 are elevational views of modified forms of coupling means.

DETAILED DESCRIPTION OF THE PREFERRED EMBODIMENT

With continuing attention to the drawings wherein applied reference numerals indicate parts hereinafter similarly identified, the reference numeral 1 indicates generally a back pack frame of lightweight tubular metal components.

A pair of main frame members at 2 and 3 are uprightly disposed intermediate shorter, upper and lower frame members 4 and 5 of curved tubular construction. When in place on the user's back, frame members 4 and 5 are located respectively above the shoulders and proximate the lower back.

Joining back pack frame members 2, 3 and 3 are coupling means shown as including pairs of flexible rod inserts at 6 and 7 which pass through apertures at 10 in upper frame member 4 downwardly into an upper segment of the main frame members a distance of several inches. The rod inserts 6 and 7 frictionally engage the main frame member internal walls by reason of the angular relationship of the common ends of the joined frame members causing the inserts to flex during insertion. A wire retainer 17 in lower frame member 5 has loops 20 to which a back pack bag B is attachable. Upwardly extending ends of wire retainer 17 are inserted into the lower ends of main frame members 2 and 3 distance of several inches to effect coupling the lower frame member 5 with the main frame members. The flexible nature of the insertable wire components results in frictional engagement of same with the internal wall surfaces of the frame member to provide a secure coupling of the members yet one readily uncoupled without the aid of tools.

A central main frame member at 8 extends the length of the back pack frame and is also tubular to internally receive later described tent frame components. Said central frame member is removably attached to the upper and lower frame members by wire clips at 9 which are swingably mounted on central member 8 by a transversely extending portion 9A. The clips have flexible leg segments 9B which may swingably engage the upper and lower frame members.

Secondary frame members are shown as inclined tubular members 12 and 13 of like lightweight construction approximately equal in length to main frame members 2 and 3. The uppermost end of each secondary frame member is proximate an end of upper frame member 4 and joined therewith by additional coupling means shown as a wire retainer 14 which extends through upper frame member 4 and has downwardly directed end segments extending into the upper ends of secondary frame members 12 and 13. Wire retainer 14 may additionally serve to provide integral loops at 15 to which the fabric back pack bag B, supported by the frame, is attached as later described. The lower ends of the two secondary members are held in place against center frame member 8 by an elastic sleeve 18 thereon.

TENT FRAME

Stowed within the main and secondary frame members of the back pack frame are extractible tent frame components which, along with the above described frame members, may be assembled to construct the tent frame of FIGS. 4 and 5.

The stowed tent frame components each comprise small diameter rods of tubular construction joined to another at their proximate ends by a wire hinge which permits the rods to be spread apart and assume a divergent relationship subsequent to extraction from the pack frame members.

With reference to FIG. 4, each main pack frame member 12 and 13 includes a downwardly extractible pair of small diameter rods as at 20–21. As typically shown in FIG. 6 the upper ends of each pair of said rods are joined by wire hinge means 24 which during extraction contacts a limit stop 25 to prevent total separation. Further, the ends of each main frame member 2 and 3 are provided with diametric slots typically shown at 27 to permit a range of divergent rod and hinge movement relative the stationary main frame member. The foregoing is also true for upwardly extractible pairs of small diameter rods as at 30–31. A similar limit stop 33 is at the like slotted upper end of the main frame members 12 and 13.

Central frame member 8 serves to receive a pair of downwardly extractible rods 34–35 which are also interconnected by a wire hinge of the above typically described type. Central frame member 8 is slotted at 39 at its lower end to permit a range of rod movement. A limit stop 36 limits rod extraction. The upper end of main member 8 is apertured at 37 to receive a connector wire 38 which is also inserted endwise into rods 30.

Main frame members 2 and 3 each serve to house extractible pairs of tent frame components at 40–41 which are downwardly positionable in a divergent relationship. The last mentioned tent frame components are small diameter (one-eighth inch) tubular rods joined at their upper ends by flexible wire hinge means at 42 of the type earlier described. Again a limit stop in the form of a pin at 43 prevents complete separation of the extractible tent frame components from their associated frame member 2 or 3. The main and secondary frame members are approximately of five-eighths inch outside diameter.

Main frame members 2 and 3 additionally house upwardly extractible pairs of frame components at 50–51 each pair joined by a wire hinge at 52 as of the type earlier described and which coacts with a limit stop pin 53 in the upper end of main frame members 2 and 3. To facilitate positioning of the pairs of frame components 40–41 and 50–51 the upper and lower ends of frame components 2 and 3 are slotted in the manner earlier described with secondary back pack frame members 12 and 13.

Flexible means shown as wire segments at 44 are insertable into the lower ends of unpaired extractible frame components 40 and 21 to join same which segments pass through sleeves 45 in place on the tent fabric. Similarly additional wire segments at 46 are insertable into the lower ends of frame components 20 and into the proximate ends of either tent frame component 34 or 35 and through a tent attached sleeve 47. A wire segment 48 attaches tent frame components 41 to a tent attached sleeve 49. A wire bridge at 54 is inserted into and couples the distal ends of tent frame components 51.

Arcuate upper and lower back pack frame members 4 and 5 are utilized to interconnect the ends of tent frame components 31 and 50 which are continuations of wire retainers 14 and 17 respectively. A clip 56 passes through aligned apertures in the two curved frame members to attach same.

The tent cover or fabric portion of tent T is formed to enclose the geodesic tent framework. For convenience sake the tent cover may include a horizontally extending closure such as a zipper 59 to simplify installation of the tent on the erected frame. As the frame components are of flexible nature the frame may be reshaped somewhat after assembly. For this purpose a line at 57 may be attached to the upper end of frame member 8 whereupon downward tensioning of the line will impart a spreading action to tent frame components 30 and to frame members 12 and 13 to cause biasing, spreading engagement of same with the inner surfaces of the tent wall. The tent is provided with tie down appendages (not shown) and a fly at the right hand side of FIG. 4.

A harness for the back pack frame includes a continuous strap 60 having unseen lower ends fitted with a buckle to enable fastening the strap ends about the wearer's lower torso. A cord 61 serves to frictionally engage strap 60 with secondary frame members 12 and 13. Rings at 62 serve to attach lower frame member 5 with the harness.

Pack bag B is of fabric construction and may include flap 63A–63B which pass about the main frame members 2 and 3 and are tensioned thereagainst as by lacing at 64.

The coupling means above described as including wire retainers and flexible rod inserts serving to join the back pack frame members 2, 3, 4, 5, 12 and 13 may be otherwise embodied. For example, the upper ends of frame members 2 and 3 may be coupled directly to secondary frame members 12 and 13 by generally horizontally extending pins or split rings passing through member apertures. Further, an alternative coupling means may include upper and lower molded connectors at 65 and 66 which insertably receive, in a snug manner the ends of the pack back frame members identified by prime reference numerals corresponding to those earlier described. Openings 65A–66A in the socket type members receive the straps securing the back pack bag.

The bag straps at S may be dispensed with in larger type bags and the bag supported on the frame in an external manner wherein bag loads are imparted initally to upper frame member 4.

In the preferred embodiment of the invention, tent frame components 50 are upward extensions of wire retainer 17 and extend upwardly, when stowed, substantially the length of main frame members 2 and 3. Tent frame components 50 are each hingedly joined to their respective companion tent frame components 51 at their upper ends by a wire hinge such as that typically shown in FIG. 6. In tent frame assembly, main frame members 2 and 3 are inverted prior to separation from lower frame member 5.

While I have shown but a few embodiments of the invention it will be apparent to those skilled in the art that the invention may be embodied still otherwise without departing from the spirit and scope of the invention.

Having thus described the invention, what is desired to be secured under a Letters Patent is:

1. A back pack frame having separable members which may be reassembled into a tent frame, said pack frame comprising, tubular back pack frame members, means coupling the tubular members to another in a detachable manner, tent frame components stowed in juxtaposition within certain of said tubular members, said tent frame components arranged in pairs with each pair axially extractible from one of said frame members and thereafter positionable to constitute a part of the tent framework, hinge means joining the tent frame components into said pairs.

2. The pack frame claimed in claim 1 wherein some of said certain tubular members additionally house a second pair of tent frame components also extractible from the tubular member but in an axial direction opposite to the extraction direction of the first mentioned pair of frame components.

3. The back pack frame claimed in claim 2 additionally including flexible means joining extracted tent frame components of different pairs.

4. The pack frame claimed in claims 1, 2 or 3 wherein said hinge means joins said components at their proximate ends to permit divergent positioning of a pair of frame components upon extraction from a frame member.

5. The back pack frame claimed in claim 4 wherein said frame components and said frame members jointly form a geodesic framework.

6. The back pack claimed in claim 1 wherein said frame members include limit stops to prevent complete extraction of a pair of frame components from a frame member.

7. The back pack frame claimed in claim 6 wherein said frame members are slotted at their ends to facilitate divergent positioning of extracted pairs of frame components.

8. The back pack frame claimed in claim 1 wherein said coupling means includes wire inserts each jointly engaging multiple back pack frame members.

9. The back pack frame claimed in claim 8 wherein said coupling means additionally includes wire retainers each integral with a tent frame component.

10. The back pack frame claimed in claim 1 wherein said coupling means includes molded connectors each defining multiple sockets for inserted reception of non-aligned frame members.

11. The back pack frame claimed in claim 10 wherein said molded connectors additionally define openings through which a back pack strap may be passed and secured.

12. In a tent frame the combination of, a tubular frame member, tent frame components stowable lengthwise in a juxtaposed manner within said frame member, means interconnecting said frame components at their common ends, said components upon extraction from said frame member divergently displaceable to constitute a portion of a tent frame, and limit means retaining the common ends of said frame components proximate one end of the tubular frame member.

13. The invention claimed in claim 12 wherein said tubular frame member defines diametrically disposed slots at one end thereof, said interconnecting means comprises a flexible wire hinge, said limit means comprises a pin located crosswise within said one end of the tubular frame member.

* * * * *